US009314914B2

(12) United States Patent
Suda et al.

(10) Patent No.: US 9,314,914 B2
(45) Date of Patent: Apr. 19, 2016

(54) POWER TOOL

(75) Inventors: Hidekazu Suda, Anjo (JP); Takuya Kusakawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 895 days.

(21) Appl. No.: 13/509,436

(22) PCT Filed: Oct. 29, 2010

(86) PCT No.: PCT/JP2010/069368
§ 371 (c)(1),
(2), (4) Date: May 15, 2012

(87) PCT Pub. No.: WO2011/058895
PCT Pub. Date: May 19, 2011

(65) Prior Publication Data

US 2012/0234573 A1 Sep. 20, 2012

(30) Foreign Application Priority Data

Nov. 11, 2009 (JP) ..... 2009-258056

(51) Int. Cl.
*B25F 5/00* (2006.01)
*B25F 5/02* (2006.01)

(52) U.S. Cl.
CPC .. *B25F 5/00* (2013.01); *B25F 5/026* (2013.01)

(58) Field of Classification Search
CPC .. B25D 2211/00; B25D 16/00; B25D 16/006; B25F 5/001
USPC ..... 173/217, 18, 152, 161, 170
See application file for complete search history.

(56) References Cited

U.S. PATENT DOCUMENTS 3,548,136 A 12/1970 Frenzel
3,632,936 A * 1/1972 Piber ..... H01H 9/063 173/170
4,734,629 A 3/1988 Lessig, III et al.

(Continued)

FOREIGN PATENT DOCUMENTS

CN 1526195 A 9/2004
EP 2039479 A1 3/2009

(Continued)

OTHER PUBLICATIONS

Office Action issued in Japanese Application No. 2009-258056 dated Jul. 30, 2013 (with translation).

(Continued)

*Primary Examiner* — Gloria R Weeks
(74) *Attorney, Agent, or Firm* — Oliff PLC

(57) ABSTRACT

A power tool includes a motor, a rotating speed adjusting switch, a regulating member, and a control unit. The regulating member regulates an upper limit position when the switch is displaced by manipulation by a user into an upper limit of any one of stages by the manipulation by the user. The control unit controls an amount of a current flowing to the motor by a duty ratio based on a manipulation amount of the switch, thereby increasing the rotating speed of the motor in accordance with an increase of the manipulation amount. A predetermined set number of duty ratios are set for each of the stages. A proportion of the predetermined set number of duty ratios to a manipulable amount of the switch is higher in a first stage having the lowest upper limit position than in the stages other than the first stage.

4 Claims, 13 Drawing Sheets

(56) References Cited

U.S. PATENT DOCUMENTS

| | | | | |
|---|---|---|---|---|
| 5,206,028 | A * | 4/1993 | Li | 424/484 |
| 5,798,584 | A * | 8/1998 | Schaeffeler et al. | 310/50 |
| 6,060,850 | A | 5/2000 | Sakabe | |
| 6,536,536 | B1 * | 3/2003 | Gass et al. | 173/2 |
| 7,320,368 | B2 * | 1/2008 | Watanabe | B25D 16/006 173/170 |
| 7,331,406 | B2 * | 2/2008 | Wottreng et al. | 173/176 |
| 7,401,663 | B2 * | 7/2008 | Craven et al. | 173/217 |
| 7,926,585 | B2 * | 4/2011 | Pozgay | B25B 21/00 173/170 |
| 8,091,756 | B2 * | 1/2012 | Viola | 227/178.1 |
| 8,587,231 | B2 * | 11/2013 | Pant | 318/400.09 |
| 8,653,764 | B2 * | 2/2014 | Oberheim | B23D 49/165 173/176 |
| 8,657,030 | B2 * | 2/2014 | Du | H02P 7/29 173/176 |
| 8,703,176 | B2 * | 4/2014 | Zhu et al. | 424/443 |
| 9,199,362 | B2 * | 12/2015 | Eshleman | B25B 21/00 |
| 2003/0047331 | A1 | 3/2003 | Henderson et al. | |
| 2005/0174706 | A1 | 8/2005 | Yuasa et al. | |
| 2005/0205274 | A1 * | 9/2005 | Bogue | 173/2 |
| 2006/0185866 | A1 * | 8/2006 | Jung et al. | 173/48 |
| 2006/0185870 | A1 * | 8/2006 | Gehret et al. | 173/217 |
| 2007/0267990 | A1 | 11/2007 | Abolhassani et al. | |
| 2009/0096401 | A1 | 4/2009 | Watabe et al. | |
| 2010/0071920 | A1 * | 3/2010 | Lau et al. | 173/1 |
| 2010/0163266 | A1 * | 7/2010 | Matsunaga et al. | 173/217 |
| 2010/0307782 | A1 | 12/2010 | Iwata et al. | |

FOREIGN PATENT DOCUMENTS

| | | |
|---|---|---|
| JP | A-47-019838 | 6/1972 |
| JP | U-1-63027 | 4/1989 |
| JP | B2-2730487 | 3/1998 |
| JP | A-10-248284 | 9/1998 |
| JP | B2-3086991 | 9/2000 |
| JP | A-2002-154073 | 5/2002 |
| JP | B2-3301533 | 7/2002 |
| JP | A-2005-219188 | 8/2005 |
| JP | A-2008-296323 | 12/2008 |
| JP | A-2009-190118 | 8/2009 |
| JP | A-2011-050312 | 3/2011 |
| WO | WO 2008/150334 A1 | 12/2008 |

OTHER PUBLICATIONS

Office Action issued in Russian Patent Application No. 2012124036 dated Jun. 16, 2014 (with translation).

Jun. 12, 2012 International Preliminary Report on Patentability issued in International Patent Application No. PCT/JP2010/069368.

Office Action issued in Chinese Application No. 201080051008.0 issued Jan. 20, 2014 (with translation).

Sep. 16, 2015 Search Report issued in European Application No. 10829855.5.

Feb. 1, 2011 International Search Report issued in International Patent Application No. PCT/JP2010/069368.

* cited by examiner

FIG.7

| STAGE NUMBER | STROKE No. | PULLING AMOUNT [mm] | SPEED COMMAND VOLTAGE [V] | DUTY LEVEL | DUTY [%] | ROTATING SPEED |
|---|---|---|---|---|---|---|
| 1 | 0 | 0.0 | 0.1 | 1 | 0 | 0 |
| | 1 | 0.5 | 0.1 | 1 | 0 | 0 |
| | 2 | 1.0 | 0.1 | 1 | 0 | 0 |
| | 3 | 1.5 | 0.2 | 2 | 5 | 80 |
| | 4 | 1.8 | 0.4 | 3 | 7 | 150 |
| | 5 | 2.0 | 0.6 | 4 | 10 | 350 |
| | 6 | 2.3 | 0.8 | 5 | 12 | 550 |
| | 7 | 2.5 | 1.0 | 6 | 14 | 750 |
| | 8 | 2.8 | 1.2 | 7 | 16 | 950 |
| | 9 | 3.0 | 1.4 | 8 | 19 | 1150 |
| | 10 | 3.2 | 1.6 | 9 | 22 | 1350 |
| | 11 | 3.5 | 1.8 | 10 | 24 | 1550 |
| | 12 | 3.8 | 2.0 | 11 | 27 | 1750 |
| | 13 | 4.0 | 2.2 | 12 | 31 | 1950 |
| | 14 | 4.3 | 2.4 | 13 | 35 | 2150 |
| | 15 | 4.5 | 2.6 | 14 | 38 | 2350 |
| 2 | 16 | 5.0 | 3.1 | 15 | 43 | 2800 |
| | 17 | 5.5 | 3.5 | 16 | 50 | 3250 |
| | 18 | 6.0 | 3.9 | 17 | 60 | 4000 |
| | 19 | 6.5 | 4.3 | 18 | 73 | 4800 |
| 3 | 20 | 7.0 | 4.7 | 19 | 82 | 5600 |
| | 21 | 7.5 | 4.9 | 20 | 95 | 6500 |
| | 22 | 8.0 | 5.0 | 21 | 100 | 7000 |
| | 23 | 8.5 | 5.0 | 21 | 100 | 7000 |

| STAGE NUMBER | STROKE No. | PULLING AMOUNT [mm] | SPEED COMMAND VOLTAGE [V] | DUTY LEVEL | DUTY [%] | ROTATING SPEED |
|---|---|---|---|---|---|---|
| 1 | 0 | 0.0 | 0.1 | 1 | 0 | 0 |
| | ▪ | ▪ | ▪ | ▪ | ▪ | ▪ |
| | ▪ | ▪ | ▪ | ▪ | ▪ | ▪ |
| | 13 | 4.0 | 2.2 | 12 | 31 | 1950 |
| | 14 | 4.3 | 2.4 | 13 | 35 | 2150 |
| | 14' | 4.4 | 2.5 | 14 | 38 | 2350 |
| | 15 | 4.5 | 2.6 | 14 | 38 | 2350 |
| 2 | 16 | 5.0 | 3.1 | 15 | 43 | 2800 |
| | 17 | 5.5 | 3.5 | 16 | 50 | 3250 |
| | 18 | 6.0 | 3.9 | 17 | 60 | 4000 |
| | 19 | 6.5 | 4.3 | 18 | 73 | 4800 |
| 3 | 20 | 7.0 | 4.7 | 19 | 82 | 5600 |
| | 21 | 7.5 | 4.9 | 20 | 95 | 6500 |
| | 22 | 8.0 | 5.0 | 21 | 100 | 7000 |
| | 23 | 8.5 | 5.0 | 21 | 100 | 7000 |

| STAGE NUMBER | STROKE No. | PULLING AMOUNT [mm] | SPEED COMMAND VOLTAGE [V] | DUTY LEVEL | DUTY [%] | ROTATING SPEED |
|---|---|---|---|---|---|---|
| 1 | 0 | 0.0 | 0.1 | 1 | 0 | 0 |
| | 1 | 0.5 | 0.1 | 1 | 0 | 0 |
| | 2 | 1.0 | 0.1 | 1 | 0 | 0 |
| | 3 | 1.5 | 0.2 | 2 | 5 | 80 |
| | ▪ | ▪ | ▪ | ▪ | ▪ | ▪ |
| | ▪ | ▪ | ▪ | ▪ | ▪ | ▪ |
| | 15 | 4.5 | 2.6 | 14 | 38 | 2350 |
| 2 | 16 | 5.0 | 3.1 | 14 | 38 | 2350 |
| | 17 | 5.5 | 3.5 | 14 | 38 | 2350 |
| | 18 | 6.0 | 3.9 | 14 | 38 | 2350 |
| | 19 | 6.5 | 4.3 | 14 | 38 | 2350 |
| 3 | 20 | 7.0 | 4.7 | 14 | 38 | 2350 |
| | 21 | 7.5 | 4.9 | 14 | 38 | 2350 |
| | 22 | 8.0 | 5.0 | 14 | 38 | 2350 |
| | 23 | 8.5 | 5.0 | 14 | 38 | 2350 |

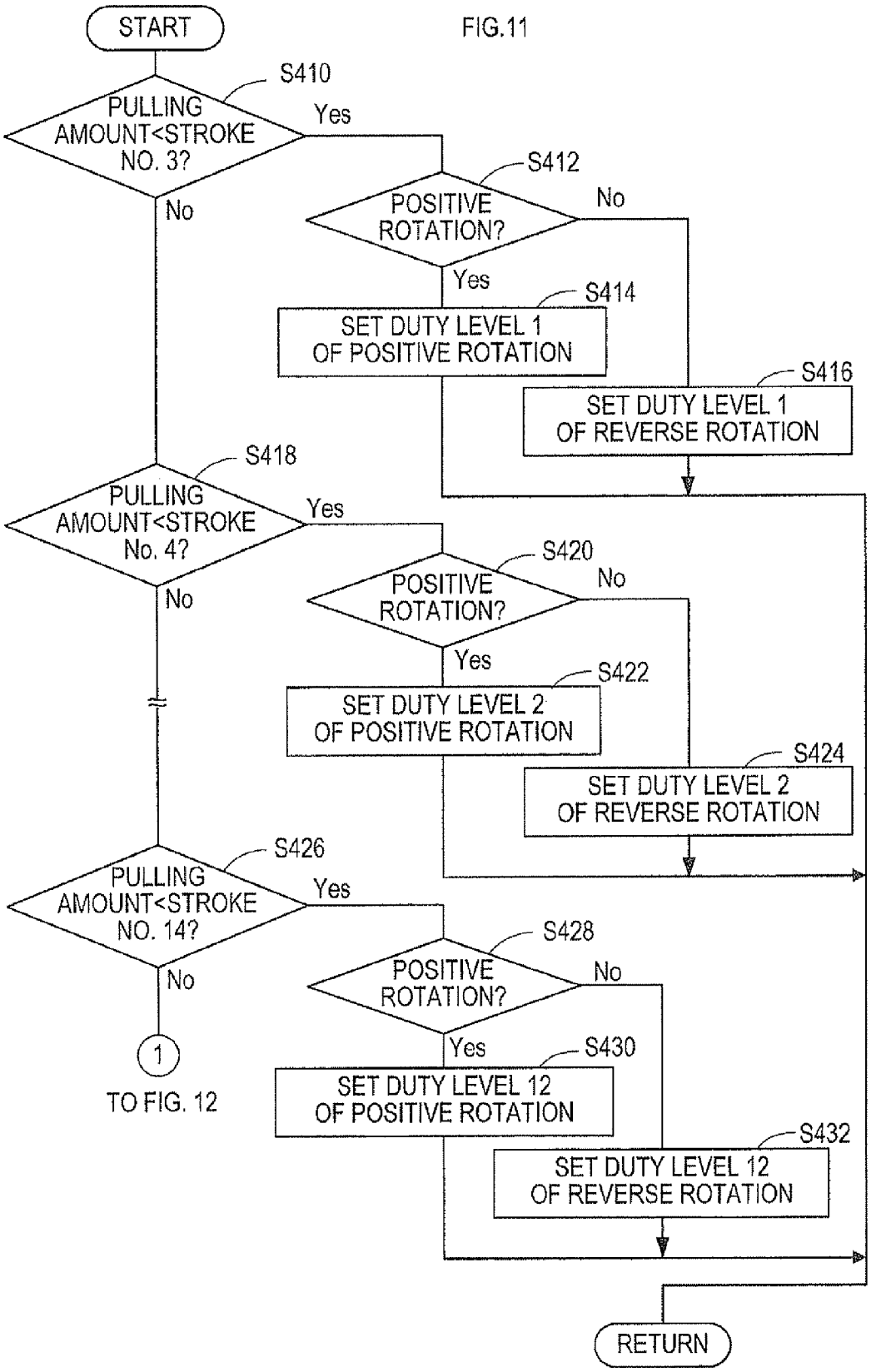
START
FIG.11
S410
PULLING AMOUNT<STROKE NO. 3?
Yes
No
S412
POSITIVE ROTATION?
No
Yes
S414
SET DUTY LEVEL 1 OF POSITIVE ROTATION
S416
SET DUTY LEVEL 1 OF REVERSE ROTATION
S418
PULLING AMOUNT<STROKE No. 4?
Yes
No
S420
POSITIVE ROTATION?
No
Yes
S422
SET DUTY LEVEL 2 OF POSITIVE ROTATION
S424
SET DUTY LEVEL 2 OF REVERSE ROTATION
S426
PULLING AMOUNT<STROKE NO. 14?
Yes
No
S428
POSITIVE ROTATION?
No
Yes
S430
SET DUTY LEVEL 12 OF POSITIVE ROTATION
S432
SET DUTY LEVEL 12 OF REVERSE ROTATION
1
TO FIG. 12
RETURN

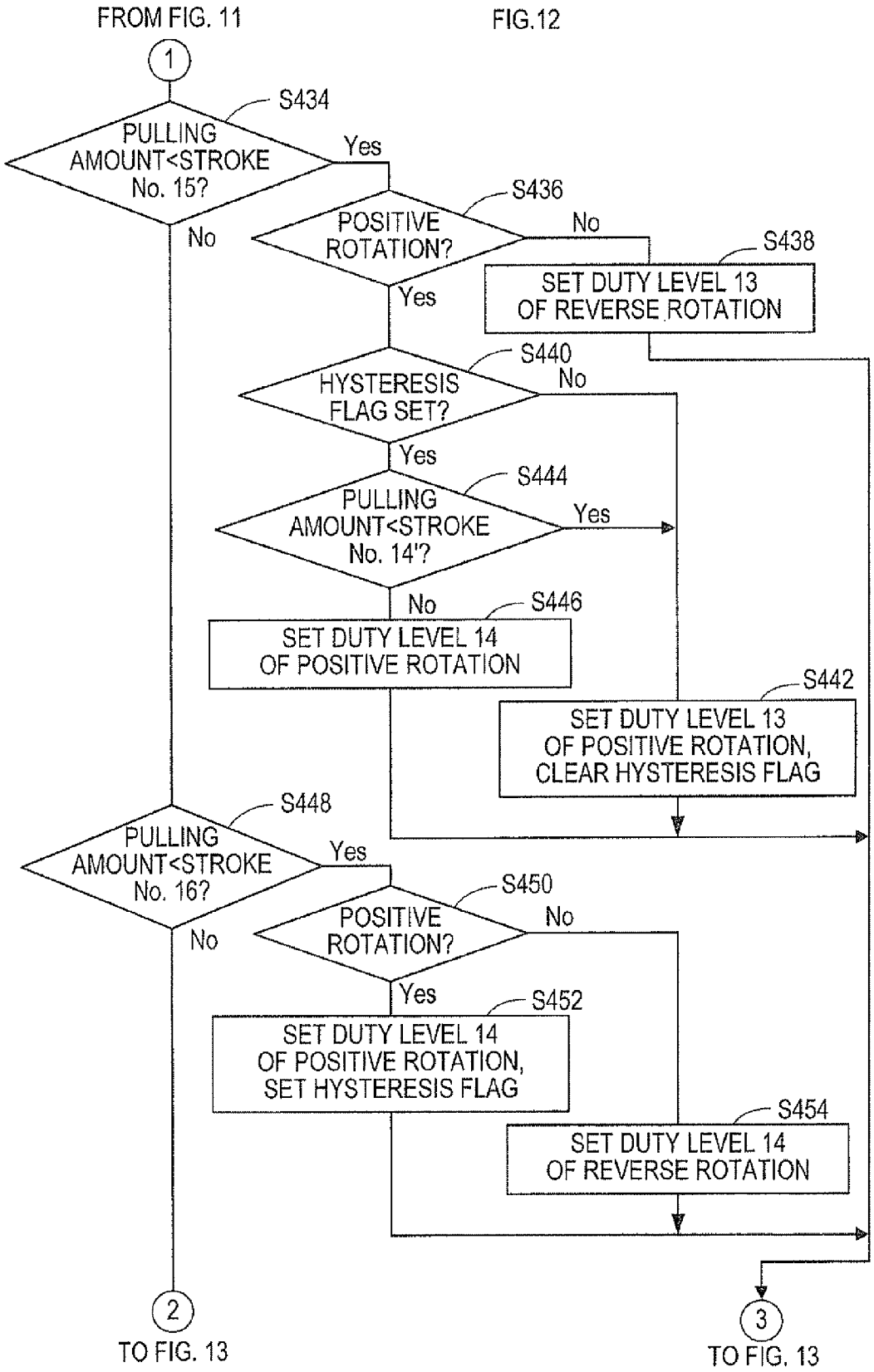
FROM FIG. 11
FIG.12
1
S434
PULLING AMOUNT<STROKE No. 15?
Yes
No
S436
POSITIVE ROTATION?
No
Yes
S438
SET DUTY LEVEL 13 OF REVERSE ROTATION
S440
HYSTERESIS FLAG SET?
No
Yes
S444
PULLING AMOUNT<STROKE No. 14'?
Yes
No
S446
SET DUTY LEVEL 14 OF POSITIVE ROTATION
S442
SET DUTY LEVEL 13 OF POSITIVE ROTATION, CLEAR HYSTERESIS FLAG
S448
PULLING AMOUNT<STROKE No. 16?
Yes
No
S450
POSITIVE ROTATION?
No
Yes
S452
SET DUTY LEVEL 14 OF POSITIVE ROTATION, SET HYSTERESIS FLAG
S454
SET DUTY LEVEL 14 OF REVERSE ROTATION
2
TO FIG. 13
3
TO FIG. 13

POWER TOOL

CROSS-REFERENCE TO RELATED APPLICATIONS

This international application claims priority based on Japanese Patent Application No. 2009-258056 filed Nov. 11, 2009 in the Japan Patent Office, the entire of which is incorporated herein by reference.

TECHNICAL FIELD

The present invention relates to a power tool which adjusts a rotating speed of a motor which drives a tool in accordance with a manipulation amount by a user.

BACKGROUND ART

Conventionally, there has been known a power tool which is driven by a motor, in which a rotating speed of a motor is controlled in accordance with a manipulation amount of a rotating speed adjusting switch which is displaced by manipulation by a user (e.g., see Patent Documents 1, 2, and 3). Normally, the small manipulation amount of the rotating speed adjusting switch causes a motor to rotate at a low speed, and the large manipulation amount of the rotating speed adjusting switch causes a motor to rotate at a high speed.

When a working operation is conducted by using such a power tool, it is sometimes desired to perform a certain working operation with the rotating speed of a motor fixed. In Patent Document 1, the manipulation amount of the rotating speed adjusting switch is mechanically regulated at a plurality of positions thereby to control a motor to the rotating speed set for each regulated position. Accordingly, when the rotating speed adjusting switch is manipulated to each regulated position, a motor is rotated with the rotating speed fixed in accordance with the regulated position and thereby the working operation can be conducted.

However, in a structure disclosed in Patent Document 1, there is a problem that since a motor can be rotated only at the rotating speed set for each regulated position, the rotating speed of a motor cannot be minutely set.

Also, when a working operation is conducted with the power tool, the rotating speed of a motor is often adjusted in accordance with the content of a working operation. For example, in the case of a driver, the face connection of a screw is performed in the low speed rotation range, while the normal fastening of a screw is performed in a high speed rotation range. In the case of a grass mower, entanglement of the grass is removed in a low speed rotation range; the grass against the wall is mowed in a medium speed range; and normal mowing of the grass is carried out in a high speed rotation range.

Here, there is a problem in the case where a working operation is conducted with a motor rotated at a low speed. That is, if an amount of changes in the rotating speed of a motor with respect to the manipulation amount of the rotating speed adjusting switch is large, it is difficult to perform a minute working operation.

Therefore, in order to improve manipulation performance when a motor is rotated at a low speed, it is conceivable to reduce the amount of changes in the rotating speed with respect to the manipulation amount as compared with that in cases where a motor is rotated at a high speed. For example, Patent Document 2 discloses the characteristics indicating that the amount of changes in the rotating speed of a motor during a low speed rotation is smaller than that during a high speed rotation.

PRIOR ART DOCUMENTS

Patent Document

Patent Document 1: Japanese Examined Patent Application Publication No. 47-49838

Patent Document 2: Japanese Unexamined Utility Model Application Publication. No. 1-63027

Patent Document 3: Japanese Patent No. 3301533

SUMMARY OF THE INVENTION

Problems to be Solved by the Invention

However, Patent Document 2 does not disclose any concrete method which realizes the characteristics that the amount of changes in the rotating speed of a motor during the low speed rotation becomes smaller than that during the high speed rotation. Therefore, it is not clear how the improved manipulation performance is realized when a minute work operation is conducted by using the power tool during the low speed rotation.

The present invention has been made to solve the above-mentioned problem. The object of this invention is to provide a power tool in which a rotating speed of a motor can be easily held at a constant rotating speed in each of a plurality of stages, and the rotating speed is controlled with high precision during the low speed rotation of a motor thereby to improve manipulation performance.

Means for Solving the Problems

The power tool according to the present invention made to achieve the above-mentioned object includes: a motor which drives a tool; a rotating speed adjusting switch which is displaced by manipulation by a user; a regulating member which regulates an upper limit position when the rotating speed adjusting switch is displaced into an upper limit position of any one of a plurality of stages by the manipulation by a user; and a control unit. In the control unit, an amount of a current flowing to the motor is controlled by a duty ratio based on a manipulation amount of the rotating speed adjusting switch; a rotating speed of the motor is increased in accordance with an increase in the manipulation amount of the rotating speed adjusting switch; a predetermined set number of duty ratios are set for each of the plurality of stages; a proportion of the set number of duty ratios to a manipulable amount of the rotating speed adjusting switch is higher in a first stage, where the upper limit position is the lowest, than in stages other than the first stage.

A manipulable amount in each stage of the rotating speed adjusting switch represents: in the first stage, a manipulation amount in a range covering from a manipulation start position of the rotating speed adjusting switch to a first upper limit position; and in a second stage and thereafter, a manipulation amount in a range covering from an upper limit position of the previous stage, i.e., from a lower limit position of the present stage, to an upper limit position of the present stage.

Thus, the upper limit position when the rotating speed adjusting switch is displaced is regulated to any one of the upper limit positions of a plurality of stages by manipulation of the regulating member by the user, so that the rotating speed adjusting switch can be easily held at each upper limit position. As a result, the rotating speed of the motor can be easily held at a rotating speed corresponding to the upper limit position. Therefore, an extended time of a working operation can be easily executed while holding the rotating speed of the motor constant.

Also, since the rotating speed of the motor is increased in accordance with an increase in the manipulation amount of the rotating speed adjusting switch, the rotating speed of the motor can be set to be adjusted in each stage.

Furthermore, a proportion of the set number of duty ratios to the manipulable amount of the rotating speed adjusting switch is configured to be higher in the first stage than in the stages other than the first stage. In other words, an interval between each manipulation amount for which a different duty ratio is set in the first stage is smaller than an interval between each manipulation amount for which a different duty ratio is set in the stages other than the first stage. Alternatively, if the range of the manipulation amount is the same, the set number of duty ratios is higher in the first stage than in the stages other than the first stage.

Accordingly, when the motor is rotated at a low speed in the first stage, since the duty ratio can be minutely changed with respect to the manipulation amount of the rotating speed adjusting switch, the rotating speed of the motor can be minutely adjusted to control the rotating speed of the motor with high resolution. As a result, workability during a low speed rotation is improved.

Here, a magnitude among the manipulable amount in each stage of the rotating speed adjusting switch may be set in any manner.

For example, the regulating member may regulate the upper limit position of the rotating speed adjusting switch so that the manipulable amount of the rotating speed adjusting switch is larger in the first stage than in the stages other than the first stage.

In this case, since a range of the rotating speed of the motor that can be selected is widened in the first stage in which the proportion of the set number of duty ratios to the manipulable amount is higher than in the stages other than the first stage, the rotating speed of the motor can be adjusted in a wide range of the rotating speed and with high precision on a low speed side. As a result, workability during a low speed rotation is improved.

Also, at least in the first stage of a plurality of stages of the rotating speed adjusting switch, when the manipulation amount of the rotating speed adjusting switch increases to the upper limit position, the duty ratio may be controlled so that the rotating speed of the motor increases; and when the manipulation amount is reduced from the upper limit position to a predetermined position, the duty ratio may be controlled by a Hysteresis characteristic in which the rotating speed of the motor remains constant until the switch is displaced to the predetermined position.

In this case, at least in the first stage, even if, for example, the fingers are loosened while the rotating speed adjusting switch is held at the upper limit position with the fingers, the rotating speed of the motor does not change until the rotating speed adjusting switch is displaced to the predetermined position. Accordingly, at least in the first stage, when an extended time of a working operation is conducted while holding the rotating speed adjusting switch at the upper limit position, the rotating speed of the motor becomes easier to be held constant.

Also, the motor may be rotated not only in a positive rotation direction but also in a reverse rotation direction. When a reverse rotation is selected, an increase in the rotating speed of the motor with respect to the manipulation amount of the rotating speed adjusting switch may be controlled in any manner in the stages other than the first stage.

For example, a rotation direction changing switch which changes a rotation of the motor into one of a positive rotation and a reverse rotation in accordance with manipulation by a user may be provided. The control unit may increase the rotating speed of the motor as the manipulation amount of the rotating speed adjusting switch increases at least in the first stage when the reverse rotation of the motor is selected by the rotation direction changing switch, and the control unit may hold the rotating speed of the motor constant regardless of the manipulation amount of the rotating speed adjusting switch in the stages other than the first stage.

Accordingly, not only the positive rotation but also the reverse rotation can be selected. When the reverse rotation is selected, the rotating speed of the motor can be adjusted in accordance with the manipulation amount of the rotating speed adjusting switch for a working operation in the stage number including at least the first stage.

During the reverse rotation, a working operation is often performed for the purpose different from during the positive rotation, and sometimes the rotating speed of the motor does not need to be high. Therefore, in the stages other than the stage number including at least the first stage, a working operation under a constant rotating speed of the motor regardless of the manipulation amount of the rotating speed adjusting switch sometimes rather improves workability.

BRIEF DESCRIPTION OF THE DRAWINGS

FIG. 7 is a list showing the characteristics among the pulling amount of the trigger switch, the speed command voltage, the duty ratio, and the rotating speed for each stage.

FIG. 11 is a flow chart showing a beginning portion in a flow of a motor control value obtaining routine.

FIG. 12 is a flow chart showing a middle portion in the flow of the motor control value obtaining routine.

EXPLANATION OF REFERENTIAL NUMERALS

10: Grass mower,
22: Motor,
36: Mowing blade,
50: Trigger switch,
70: Pulling amount changing switch,
90: Rotation direction changing switch,
102: Microcomputer

MODE FOR CARRYING OUT THE INVENTION

An embodiment of the present invention will be described below based on the drawings.

(Entire Configuration of Grass Mower 10)

Figure 1:
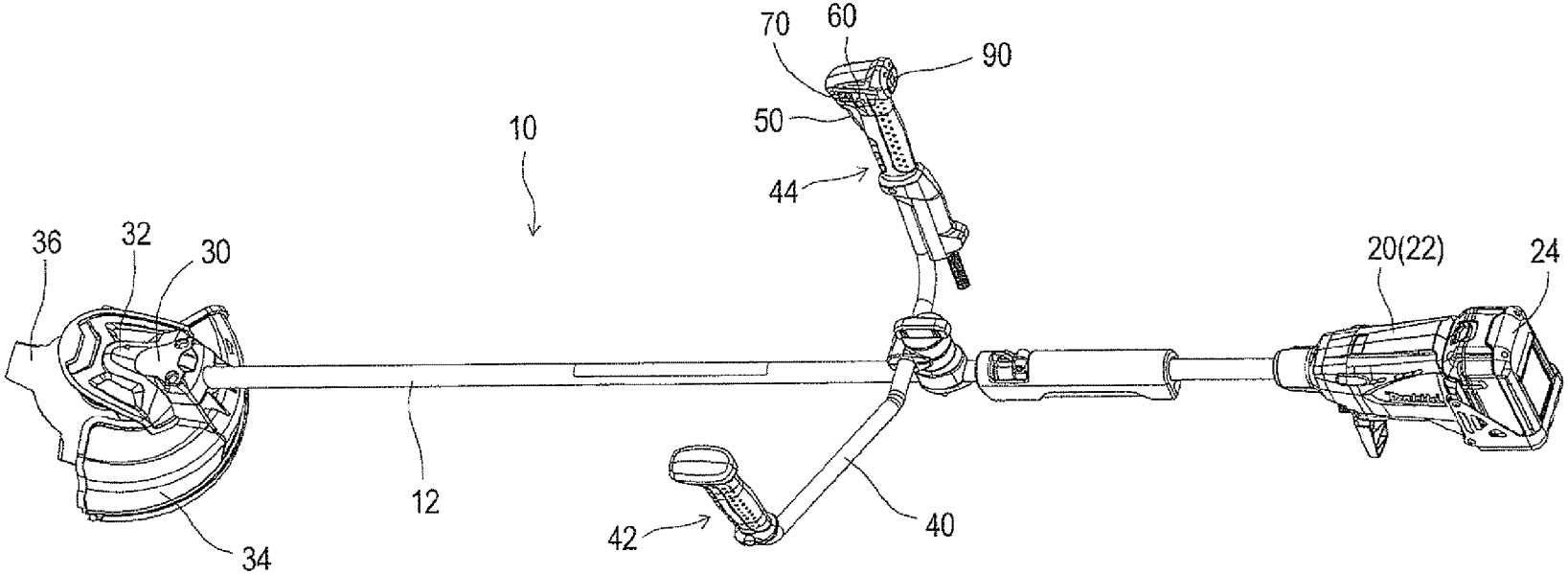
FIG. 1 is a perspective view showing an entire configuration of the power grass mower in an embodiment.

As shown in FIG. 1, a rechargeable grass mower 10 includes a shaft pipe 12, a motor unit 20, a battery 24, and a mowing blade unit 30.

The shaft pipe 12 is formed in a hollow rod-like shape having a predetermined length. The motor unit 20 and the battery 24 are disposed on one end side of the shaft pipe 12, and the mowing blade unit 30 is disposed on the other end side of the shaft pipe 12. The shaft pipe 12 includes a driving force transmitting shaft (not shown) housed therein. The driving force transmitting shaft transmits a rotational driving force of the motor unit 20 to the mowing blade unit 30.

The motor unit 20 houses a motor 22, a controller 100 (see FIG. 5), and the like. The motor 22 of the present embodiment is a brushed DC motor. The motor 22 rotationally drives a mowing blade 36 attached to the mowing blade unit 30 via the driving force transmitting shaft housed in the shaft pipe 12. The controller 100 includes various electronic circuits which control a current carried from the battery 24 to the motor 22, a microcomputer 102 (see FIG. 5), and the like. The controller 100 will be described in detail later.

The battery 24 is a rechargeable power source which supplies electric power to the motor 22 of the motor unit 20, and is attachable to or detachable from the motor unit 20.

The mowing blade unit 30 is provided with a gear case 32 and a cover 34. The gear case 32 includes various gears which transmit the driving force of the motor 22 from the driving force shaft housed in the shaft pipe 12 to the mowing blade 36.

The cover 34 covers a user side of the mowing blade 36 so as to inhibit the grass mowed with the mowing blade 36 from flying toward the user side.

The mowing blade 36 is formed in a circular plate shape, and is attachable to and detachable from the mowing blade unit 30. In place of the plate-like mowing blade 36, a string-like mowing blade such as a nylon cord can be also attached to the mowing blade unit 30.

A handle 40 is formed in a U shape, and connected to the shaft pipe 12 between the motor unit 20 and the mowing blade unit 30 on the shaft pipe 12. Of both ends of the handle 40, an end on a left side toward the mowing blade unit 30 from the motor unit 20 is provided with a left hand grip 42, while an end on a right side is provided with a right hand grip 44. The left hand grip 42 and the right hand grip 44 are provided so that a user grasps each of the grips to hold the grass mower 10.

Figure 2:
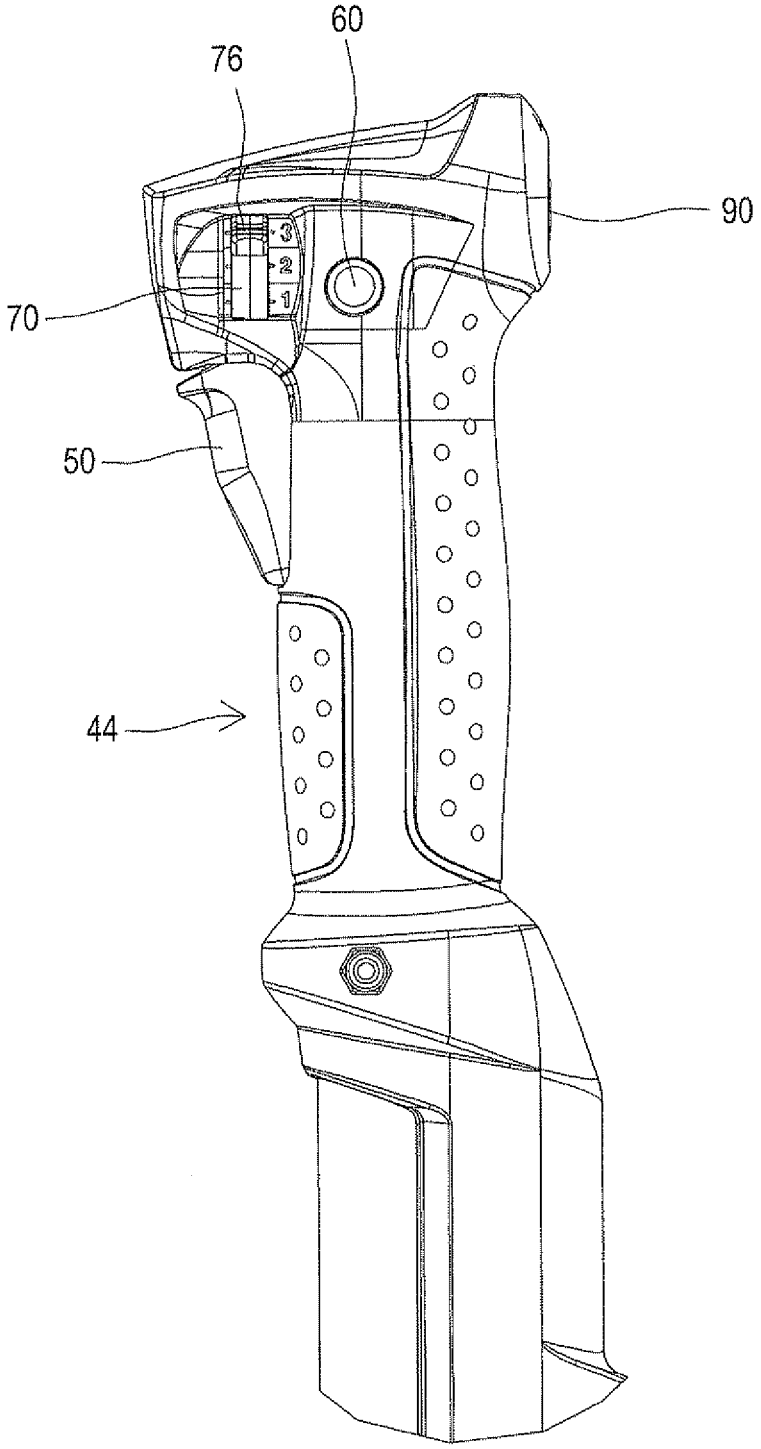
FIG. 2 is a side view showing the right hand grip.
Figure 3:
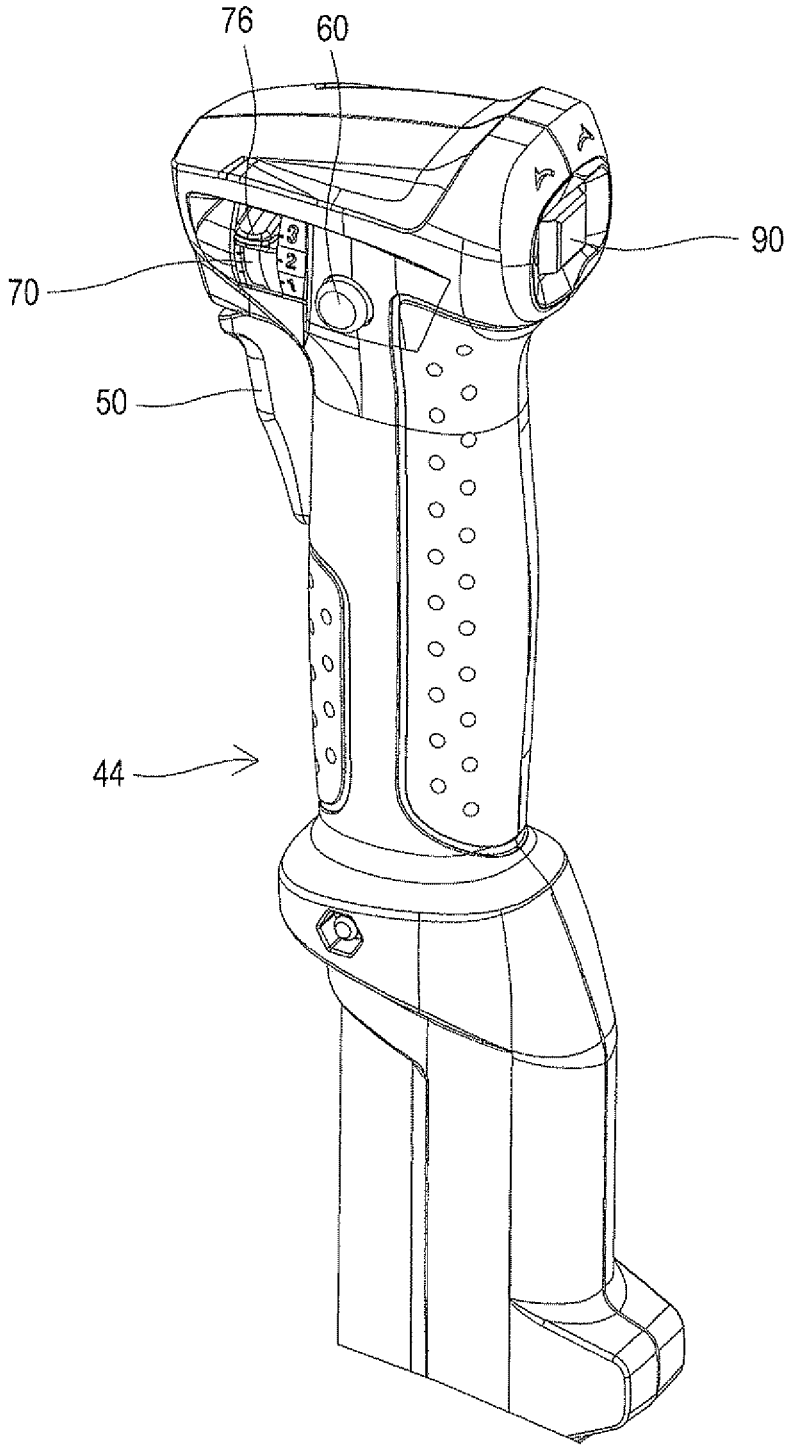
FIG. 3 is a perspective view showing the right hand grip.

As shown in FIG. 2 and FIG. 3, the right hand grip 44 is provided with a trigger switch 50, a lock-off switch 60, a pulling amount changing switch 70, and a rotation direction changing switch 90.

The trigger switch 50 outputs a speed command voltage to the controller 100 described later in accordance with a pulling amount, by the fact, for example, that the resistance value of a variable resistance is changed in accordance with the pulling amount as a manipulation amount.

In FIG. 2, the trigger switch 50 projects most toward a side of the mowing blade unit 30 from the right hand grip 44. When a user pulls the trigger switch 50 from the state in FIG. 2, a current starts to be carried to the motor 22 of the motor unit 20. An amount of the current carried to the motor 22 is controlled by a duty ratio in accordance with a pulling amount of the trigger switch 50. A rotating speed of the motor 22 is increased as the pulling amount increases. That is, as the pulling amount of the trigger switch 50 increases, a rotating speed of the mowing blade 36 is increased.

The lock-off switch 60 is a push-button type switch for inhibiting misoperation of the mowing blade 36. While the lock-off switch 60 is not pressed, the Jock-off switch 60 engages with the trigger switch 50, thereby mechanically regulating the trigger switch 50 from being pulled.

While the lock-off switch 60 is not pressed, the current carried from the battery 24 to the motor unit 20 is turned OFF. An electric circuit that connects the battery 24 and the motor unit 20 is provided with an unshown semiconductor switch. The semiconductor switch is turned OFF while the lock-off switch 60 is not pressed, and is turned ON while the lock-off switch 60 is pressed.

Accordingly, while the lock-off switch 60 is not pressed, the semiconductor switch is turned OFF, and the current carried from the battery 24 to the motor unit 20 is inhibited regardless of a position of the trigger switch 50. Therefore, even if the trigger switch 50 is short-circuited, as long as the lock-off switch 60 is not pressed, the mowing blade 36 can be inhibited from being accidentally rotated.

On the other hand, while the lock-off switch 60 is pressed, the semiconductor switch is turned ON, so that the amount of the current carried from the battery 24 to the motor unit 20 is controlled by the duty ratio in accordance with the pulling amount of the trigger switch 50. Accordingly, the rotating speed of the mowing blade 36 is controlled in accordance with the pulling amount of the trigger switch 50.

The pulling amount changing switch 70 is a switch for mechanically regulating an upper limit position of the trigger switch 50, which is displaced by the fact that a user pulls the trigger switch 50, to three stages. The upper limit position at which the trigger switch 50 is displaced is regulated, so that an upper limit of the rotating speed of the mowing blade 36 can be switched to three stages.

The pulling amount changing switch 70 rotates and stops at either of the positions shown as "1", "2", and "3" in FIG. 2 and FIG. 3. As the stop position is changed to "1", "2", and "3" in order, the upper limit position of the trigger switch 50 increases, thereby increasing the upper limit of the rotating speed of the mowing blade 36.

Figure 4A:
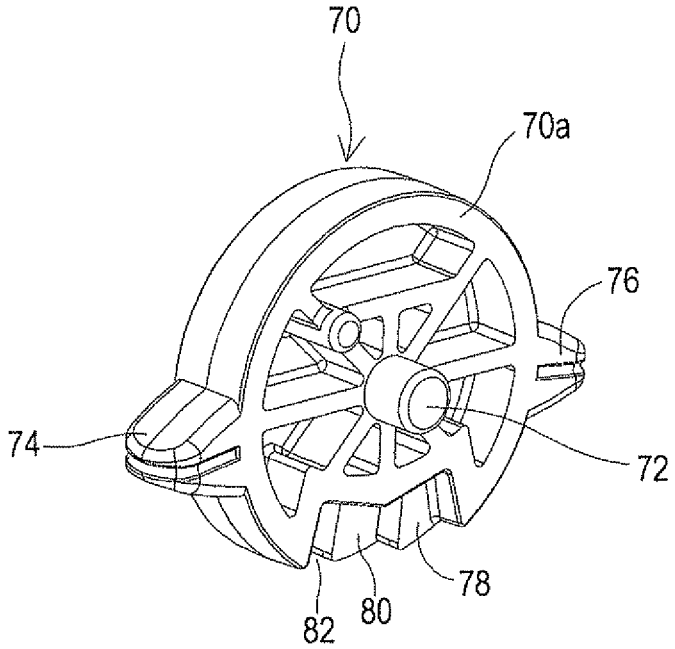
FIG. 4A is a perspective view showing a front side of the pulling amount changing switch.
Figure 4B:
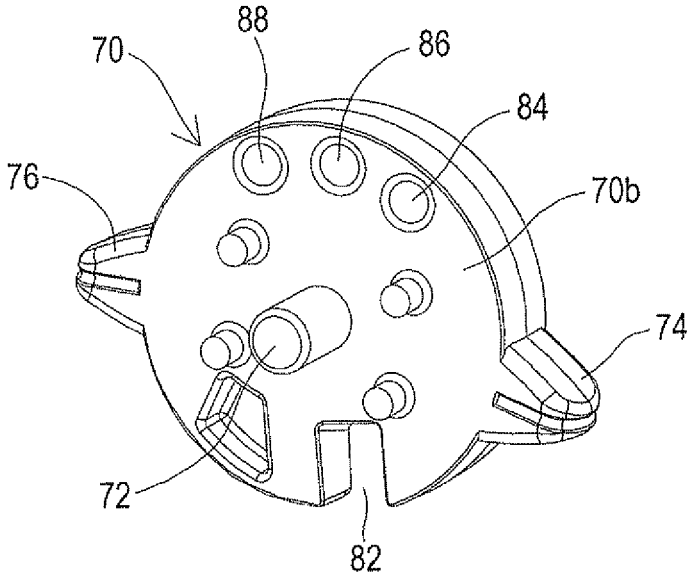
FIG. 4B is a perspective view showing a back side of the pulling amount changing switch.

As shown in FIGS. 4A and 4B, the pulling amount changing switch 70 is formed in a circular plate-like shape, in which a shaft 72 disposed in a central portion is rotatably supported by the right hand grip 44. The pulling amount changing switch 70 includes projections 74 and 76 on both sides thereof in radial direction. The projections 74 and 76 project toward an outer side of the right hand grip 44, and are capable of rotating the pulling amount changing switch 70 by manipulating the projections 74 and 76 with a user's finger.

Three notches 78, 80, and 82, which differ in depth, are formed toward a rotation axis direction on a front surface 70*a* on a mowing blade unit 30 side of the pulling amount changing switch 70. The notch 78 is shallowest in depth, and the depth becomes deeper in the order of the notch 80 and the notch 82. The deepest notch 82 runs through the pulling amount changing switch 70 in a plate thickness direction.

An unshown convex part projecting toward the pulling amount changing switch 70 is provided to the trigger switch 50 on a side of the trigger switch 50 which faces the pulling amount changing switch 70. The convex part faces one of the notches 78, 80, and 82 in accordance with a rotation position of the pulling amount changing switch 70, thereby mechanically regulating the upper limit position when the trigger switch 50 is displaced.

The rotation position of the pulling amount changing switch. 70 when the convex part of the trigger switch 50 faces the notch 78 corresponds to the position shown as "1" in FIG. 2 and FIG. 3; the rotation position of the pulling amount changing switch 70 when the convex part of the trigger switch 50 faces the notch 80 corresponds to the position shown as "2" in FIG. 2 and FIG. 3; and the rotation position of the pulling amount changing switch 70 when the convex part of the trigger switch 50 faces the notch 82 corresponds to the position shown as "3" in FIG. 2 and FIG. 3.

Three concave parts 84, 86, and 88 are formed along a circumferential direction on a back surface 70*b* on a motor unit 20 side of the pulling amount changing switch 70. A coil spring and a ball, which are unshown, are arranged on the motor unit 20 side of the pulling amount changing switch 70. The ball is pushed against the back surface 70*b* of the pulling amount changing switch 70 with a load of the coil spring.

Then, the pulling amount changing switch 70 rotates so that the ball engages with one of the concave parts 84, 86, and 88, thereby regulating rotation of the pulling amount changing switch 70. When a user applies a rotational force to the pulling amount changing switch 70 against the load of the coil spring, the ball is pulled out of one of the concave parts 84, 86, and 88 so that the pulling amount changing switch 70 become rotatable.

The rotation direction changing switch 90 shown in FIG. 2 and FIG. 3 is a switch which switches a rotation direction of the motor 22, that is a rotation direction of the mowing blade 36, between the positive rotation and the reverse rotation. For example, a rocker switch is applied as the rotation direction changing switch 90. When a user selects and pushes a left side of the rotation direction changing switch 90, the rotation direction of the mowing blade 36 is set in a positive rotation direction. When a user selects and pushes a right side thereof, the rotation direction of the mowing blade 36 is set in a reverse rotation direction.

(Electrical Configuration of Grass Mower 10)

Figure 5:
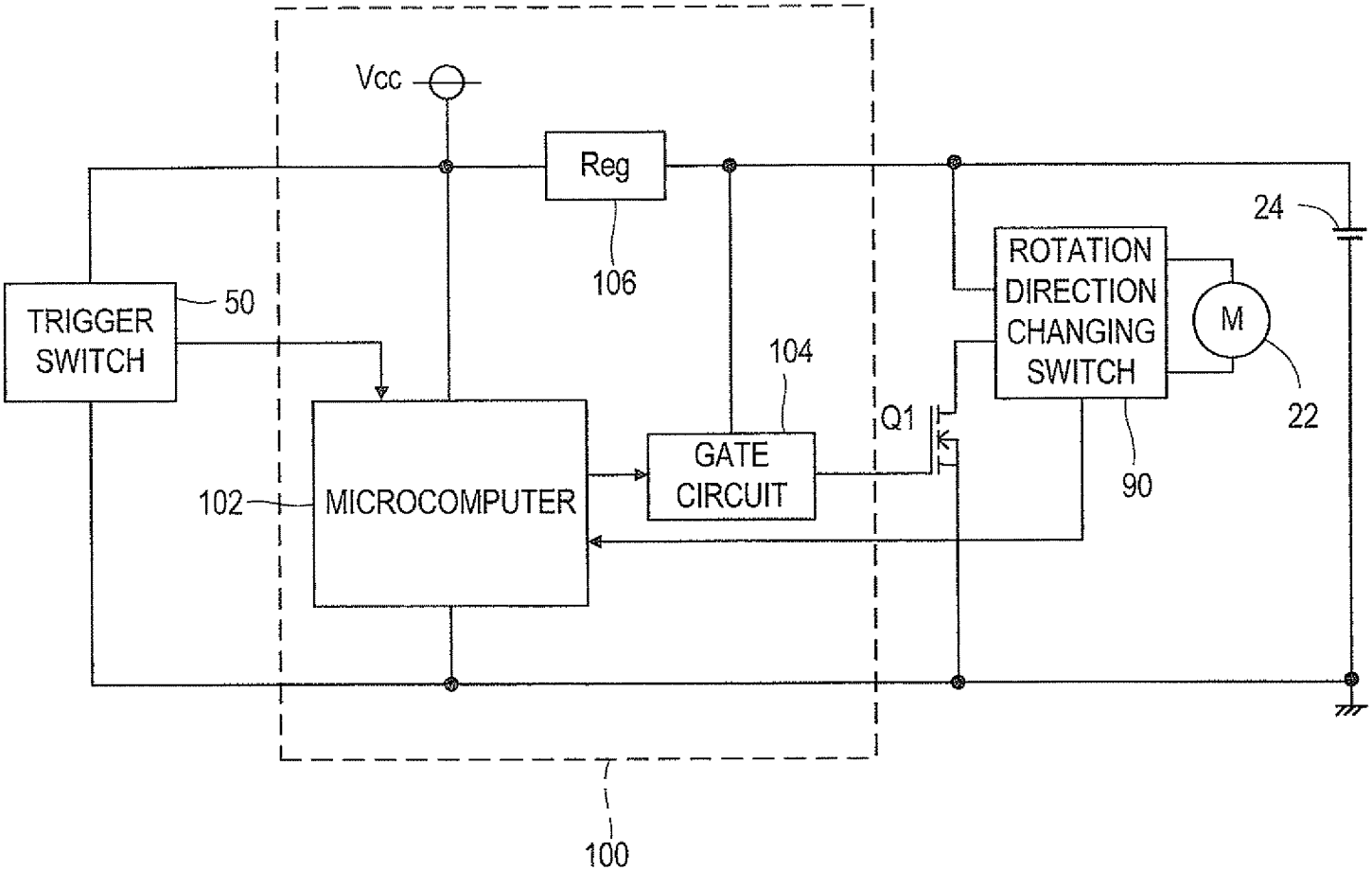
FIG. 5 is a block diagram showing the electrical configuration of the grass mower.

As shown in FIG. 5, in the grass mower 10, a semiconductor switch Q1 is arranged in a circuit in which a current is carried from the battery 24 to the motor 22. The controller 100 is a circuit which controls turning ON/OFF of the semiconductor switch Q1 as well as an amount of a current which flows through the semiconductor switch Q1. Here, the semiconductor switch Q1 is different from the previously mentioned semiconductor switch that is turned ON/OFF by the lock-off switch 60.

The semiconductor switch Q1 is constituted by an N-channel MOSFET. An OFF state of the semiconductor switch Q1 interrupts the current carried to the motor 22, and an ON state of the semiconductor switch Q1 permits the current carried to the motor 22. A gate of the semiconductor switch Q1 is connected to the microcomputer 102 via a gate circuit 104 in the controller 100. A source of the semiconductor switch Q1 is connected to a negative terminal of the battery 24, and the drain of the semiconductor switch Q1 is connected to the rotation direction changing switch 90.

The controller 100 is provided with the microcomputer 102, the gate circuit 104, and a constant voltage power source circuit 106.

The microcomputer 102 is constituted by a CPU, various memories, an input/output interface, and the like, and turns ON/OFF the semiconductor switch Q1 based on the speed command voltage output from the trigger switch 50 in accordance with the pulling amount of the trigger switch 50.

Furthermore, when the trigger switch 50 is turned ON, the microcomputer 102 outputs a PWM signal to the gate circuit 104. The PWM signal turns ON/OFF the semiconductor switch Q1 so that a desired current flows to the motor 22 based on the duty ratio set in accordance with the pulling amount of the trigger switch 50. The PWM signal controls a current which flows through the semiconductor switch Q1, that is a current which flows to the motor 22.

The gate circuit 104 is supplied with a power source from the battery 24 to turn ON/OFF the semiconductor switch Q1 in accordance with the PWM signal from the microcomputer 102. The constant voltage power source circuit (Reg) 106 reduces a power of the battery 24 to a predetermined voltage (e.g., 5V) of a controlling power source Vcc, and supplies the controlling power source Vcc to each part in the controller 100. The microcomputer 102 is supplied with the controlling power source from the constant voltage power source circuit 106 for operation.

(Control of the Rotating Speed)

Next, control of the rotating speed of the motor 22 in the positive rotation direction in accordance with the pulling amount of the trigger switch 50 will be described.

Figure 6A:
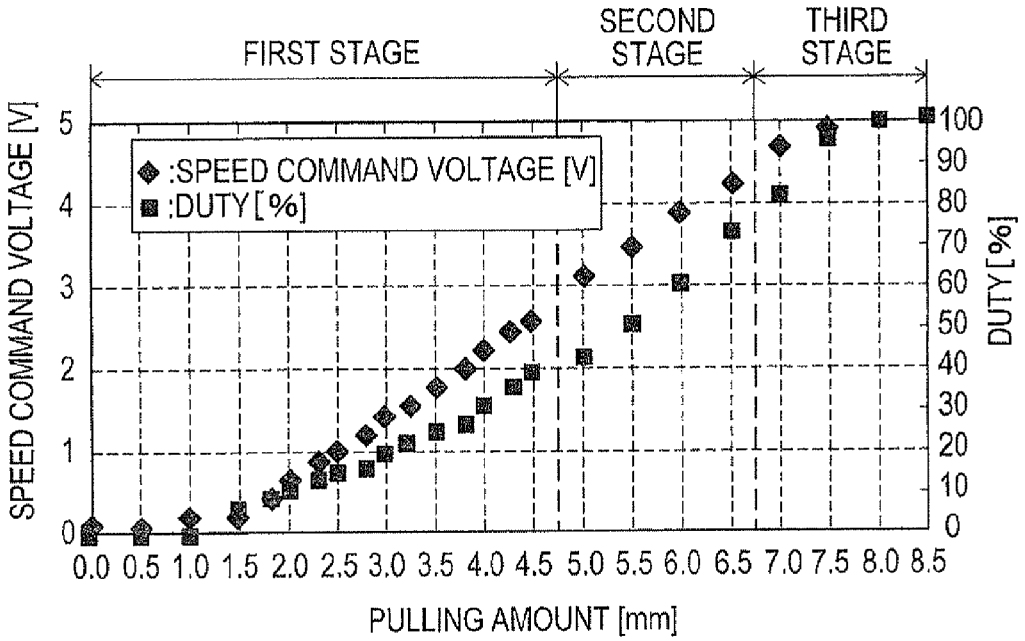
FIG. 6A is a characteristics diagram showing a relationship among a pulling amount of a trigger switch, a speed command voltage, and a duty ratio.
Figure 6B:
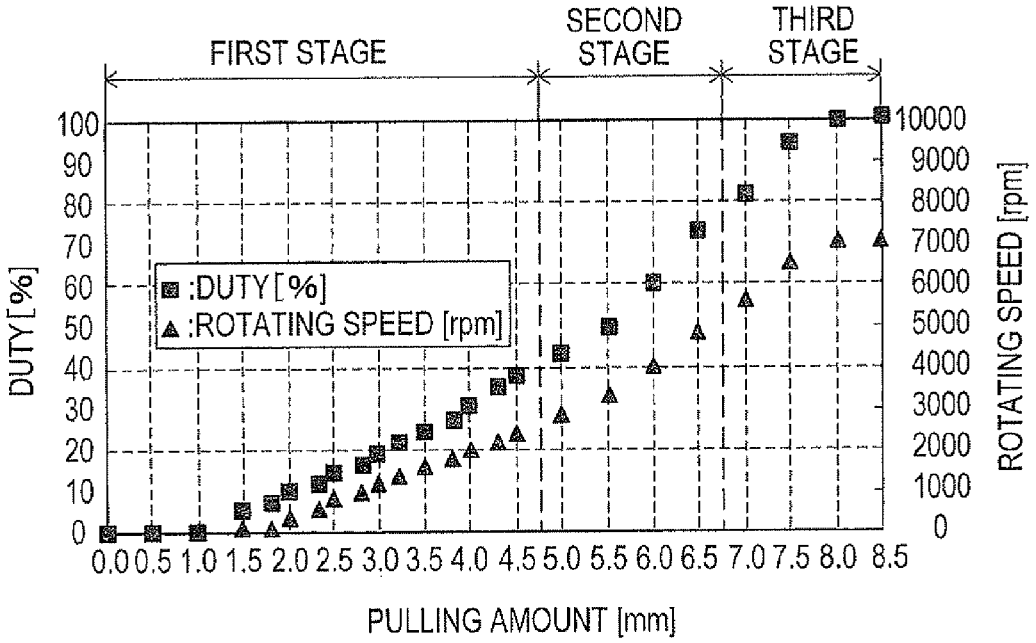
FIG. 6B is a characteristics diagram showing a relationship among the pulling amount of the trigger switch, the duty ratio, and a rotating speed of a motor.

FIGS. 6A and 6B show the characteristics among the pulling amount of the trigger switch 50, the speed command voltage, the duty ratio, and the rotating speed, and FIG. 7 shows a list thereof. The rotating speed shown in FIG. 6B is the rotating speed of the motor 22, and not the rotating speed of the mowing blade 36. However, since an increase of the rotating speed of the motor 22 is accompanied by an increase of the rotating speed of the mowing blade 36, although a value of the rotating speed of the mowing blade 36 differs from the value of the rotating speed shown in FIG. 6B, the rotating speed of the mowing blade 36 indicates the same characteristics as the rotating speed of the motor 22.

The upper limit position when the trigger switch 50 is displaced is regulated to three stages by the pulling amount changing switch 70 as previously discussed. An upper limit position in a first stage is the smallest, and the upper limit position becomes larger in the order of a second stage and a third stage. That is, a maximum rotating speed of the motor 22 in the first stage is the smallest, and the maximum rotating speed becomes larger in the order of the second stage and the third stage.

Also, as shown in FIGS. 6A and 6B, a manipulable amount in which the trigger switch 50 can be pulled in the first stage is the largest, and the manipulable amount becomes smaller in the order of the second stage and the third stage.

Regarding the manipulation amount of the trigger switch 50 in each stage, a manipulation amount in the first stage represents a manipulation amount in a range covering from a manipulation start position of the trigger switch 50 to a first upper limit position; and a manipulation amount in the second stage and thereafter represents a manipulation amount in a range covering from an upper limit position of the previous stage, i.e., a lower limit position of the present stage, to an upper limit position of the present stage.

Also, in the microcomputer 102, a predetermined set number of duty ratios are set for each of three stages. A proportion of the set number of duty ratios to the manipulable amount in each stage is higher in the first stage than in the second stage and the third stage.

With respect to each stage, the microcomputer 102 stores, as a map, a corresponding relationship between the speed command voltage output from the trigger switch 50 and the duty ratio for each of the previously mentioned set number, in a memory such as a ROM in the microcomputer 102.

(Hysteresis characteristic of the Rotating Speed)

When a user pulls the trigger switch 50 to the upper limit position while the pulling amount changing switch 70 is set at the first stage, the duty ratio increases in accordance with the pulling amount, thereby increasing the rotating speed of the motor 22 that is the rotating speed of the mowing blade 36. When a user holds the trigger switch 50 at the upper limit position of the first stage, the rotating speed of the mowing blade 36 is held at a maximum rotating speed in the first stage.

Here, for example, when a user feels fatigue in the fingers clue to an extended time of a working operation such that a force of holding the trigger switch 50 at the upper limit position is reduced thereby causing the trigger switch 50 to slightly return from the upper limit position to decrease the pulling amount, the speed command voltage output from the trigger switch 50 decreases as the pulling amount of the trigger switch 50 is reduced from the upper limit position.

The microcomputer 102 can detect the slight return of the trigger switch 50 from the upper limit position based on the speed command voltage output from the trigger switch 50.

When the trigger switch 50 is slightly returned from the upper limit position, the microcomputer 102 does not reduce the duty ratio in accordance with the speed command voltage output from the trigger switch 50, but sets the duty ratio at the same value as for the upper limit position to have the Hysteresis characteristic.

Figures 8A, 8B:
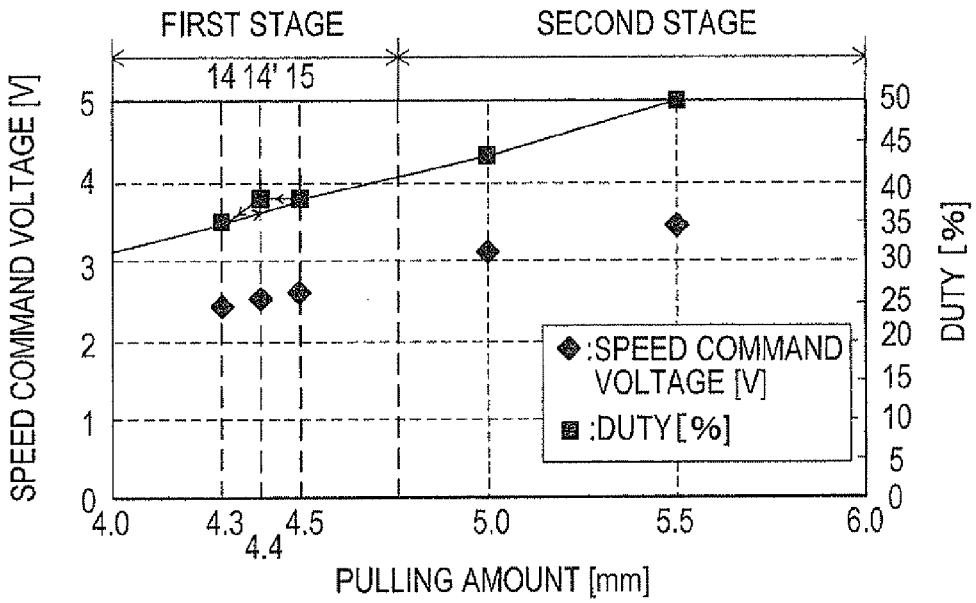
FIG. 8A is the Hysteresis characteristic diagram showing a relationship between the pulling amount of the trigger switch and the duty ratio.
FIG. 8B is a list showing the Hysteresis characteristic between the pulling amount of the trigger switch and the duty ratio.

In FIGS. 8A and 8B, the same duty ratio is set while the pulling amount is returned from 4.5 mm of the upper limit position to 4.4 mm. Accordingly, the rotating speed of the mowing blade 36 is held at the maximum rotating speed which is the same as that in the upper limit position, while the pulling amount is returned from 4.5 mm of the upper limit position to 4.4 mm.

(Control in Reverse Rotation)

Next, control of the rotating speed in the reverse rotation direction of the mowing blade 36 in accordance with the pulling amount of the trigger switch 50 will be described.

The microcomputer 102 detects which of the positive rotation direction and the reverse rotation direction the rotation direction changing switch 90 is set in, based on an output signal from the rotation direction changing switch 90.

Figures 9A, 9B:
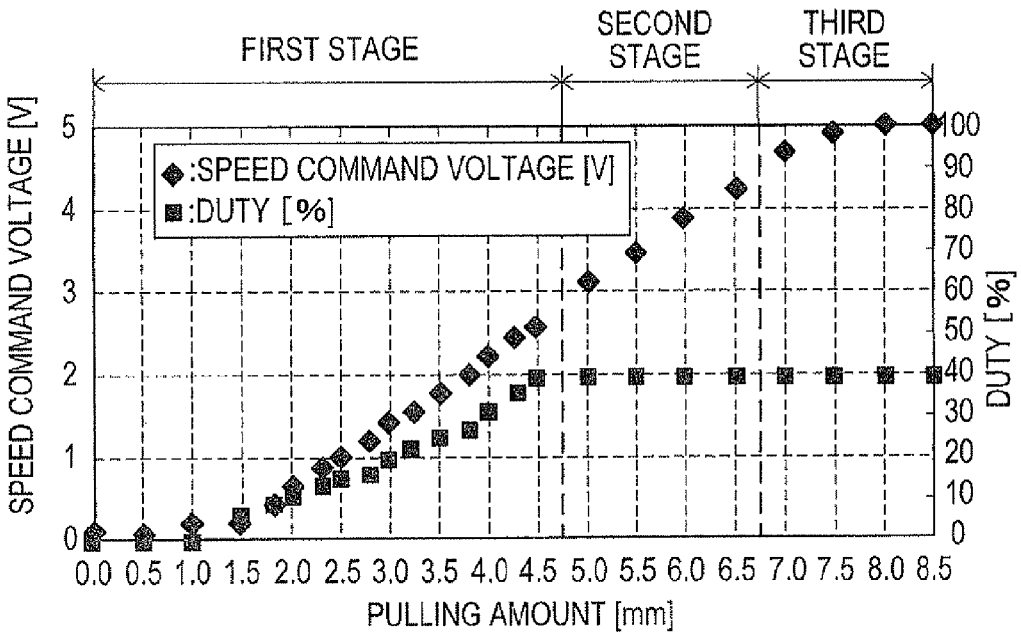
FIG. 9A is a characteristics diagram showing a relationship among the pulling amount of the trigger switch, the speed command voltage, and the duty ratio during a reverse rotation.
FIG. 9B is a list showing a relationship among the pulling amount of the trigger switch, the speed command voltage, and the duty ratio during the reverse rotation.

Then, when the rotation direction changing switch 90 is set in the reverse rotation direction, while the pulling amount of the trigger switch 50 is in a range of the first stage, the microcomputer 102 increases the rotating speed of the motor 22 in accordance with an increase of the pulling amount of the trigger switch 50, for example, based on the same characteristics as in the positive rotation, as shown in FIGS. 9A and 9B. In this case, similarly to in the positive rotation, the same duty ratio as in the upper limit position may be set while the pulling amount is returned from 4.5 mm of the upper limit position to 4.4 mm.

On the other hand, when the microcomputer 102 detects that the trigger switch 50 is manipulated in the second stage or the third stage based on the speed command voltage that is an output of the trigger switch 50, as shown in FIGS. 9A and 9B, the microcomputer 102 holds the rotating speed in the second stage and the third stage at the maximum rotating speed of the first stage regardless the pulling amount of the trigger switch 50.

(Control Routine of the Rotating Speed)

Next, processing executed by the microcomputer 102 in order to realize the above-mentioned control will be specifically described. FIGS. 10 to 13 show a control routine of the rotating speed of the motor 22 which the microcomputer 102 performs by executing a control program stored in a memory such as a ROM. In FIGS. 10 to 13, "S" represents a step.

(Main Routine)

Figure 10:
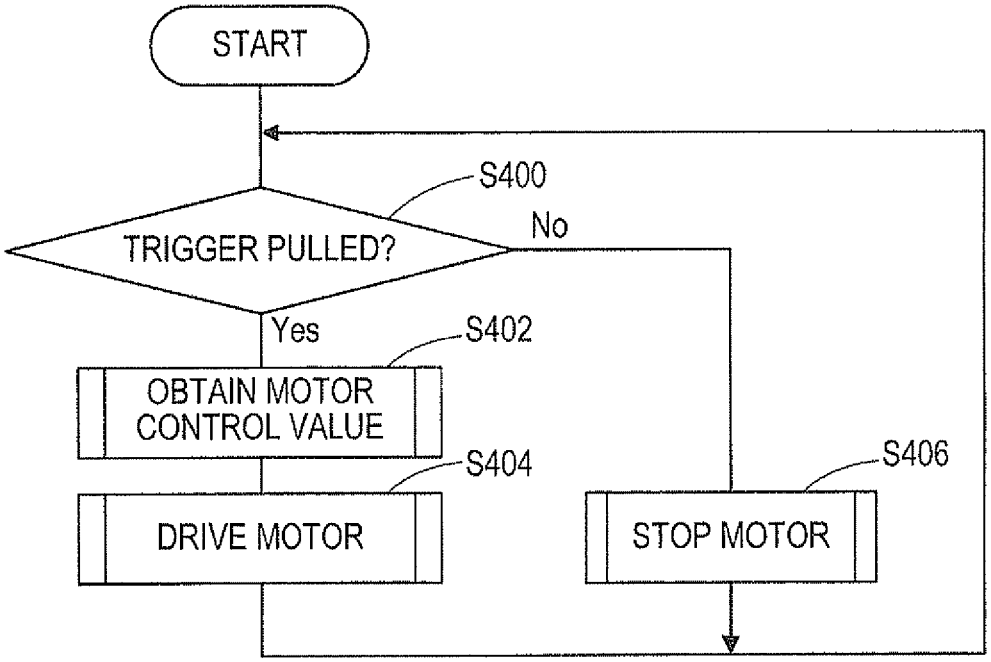
FIG. 10 is a flow chart showing a main routine for control of the rotating speed of the motor.

In FIG. 10, a main routine of the rotating speed control of the motor 22 is shown. The routine in FIG. 10 is executed at all time.

First, in the main routine, it is determined whether or not the trigger switch 50 is pulled (S400). When the trigger switch 50 is pulled (S400: Yes), based on the rotation direction set by the rotation direction changing switch 90, the duty ratio of the PWM signal, which controls the amount of the current flowing to the motor 22 is obtained together with the pulling amount of the trigger switch 50 (S402). Then, based on the obtained duty ratio, the current flowing to the motor 22 is controlled to rotationally drive the motor 22 (S404).

When the trigger switch 50 is neither manipulated nor pulled (S400: No), rotation of the motor 22 is terminated (S406).

(Motor Control Value Obtaining Routine)

Figure 13:
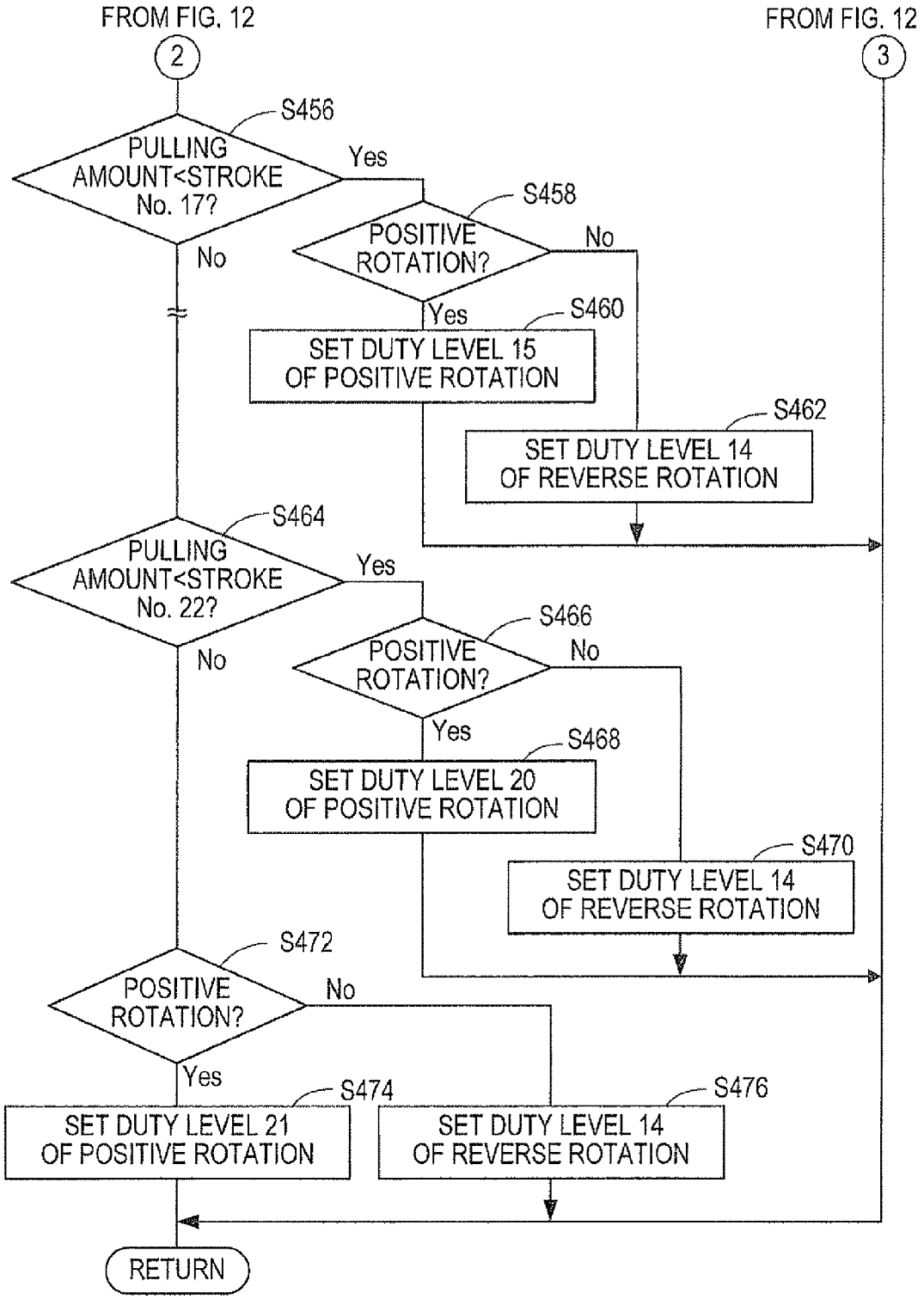
FIG. 13 is a flow chart showing a final portion in the flow of the motor control value obtaining routine.

FIGS. 11, 12, and 13 show a routine (the above-mentioned S402) for obtaining the duty ratio of the PWM signal as a control value to the motor 22.

As shown in FIGS. 11 to 13, when the pulling amount of the trigger switch 50 is smaller than Stroke No. 3 shown in FIG. 7 and FIGS. 9A and 9B (S410: Yes), it is determined whether or not the positive rotation is set by the rotation direction changing switch 90 (S412).

When the positive rotation is set (S412: Yes), a duty level 1 of the positive rotation is set as the duty ratio of the PWM signal (S414), and then the routine is terminated.

When the reverse rotation is set (S412: No), a duty level 1 of the reverse rotation is set as the duty ratio of the PWM signal (S416), and then the routine is terminated.

In the present embodiment, 0% is set as the duty ratio when the pulling amount of the trigger switch 50 is smaller than the Stroke No. 3 for both the positive rotation and the reverse rotation (see FIG. 7 and FIGS. 9A and 9B). In other words, when the pulling amount of the trigger switch 50 is smaller than Stroke No. 3, the motor 22 is not rotated.

When the pulling amount of the trigger switch 50 is equal to or above Stroke No. 3 (S410: No) and smaller than No. 4 (S418: Yes), it is determined whether or not the positive rotation is set by the rotation direction changing switch 90 (S420).

When the positive rotation is set (S420: Yes), a duty level 2 of the positive rotation is set as the duty ratio of the PWM signal (S422), and then the routine is terminated.

When the reverse rotation is set (S420: No), a duty level 2 of the reverse rotation is set as the duty ratio of the PWM signal (S424), and then the routine is terminated.

In the present embodiment, when the pulling amount of the trigger switch 50 becomes equal to or above Stroke No. 3 in both the positive rotation and the reverse rotation, a value larger than 0% is set as the duty ratio (see FIG. 7 and FIGS. 9A and 9B). In other words, when the pulling amount of the trigger switch 50 becomes equal to or above Stroke No. 3, the motor 22 is rotated.

Thereafter, in S426 to S432, when the pulling amount is equal to or below Stroke No. 13, the duty ratio of the PWM signal is set based on the pulling amount of the trigger switch 50 and the rotation direction set by the rotation direction changing switch 90.

Next, when the pulling amount of the trigger switch 50 is equal to or above No. 14 (S426: No), and smaller than Stroke No. 15 (S434: Yes), it is determined whether or not the positive rotation is set by the rotation direction changing switch 90 (S436).

When the reverse rotation is set (S436: No), a duty level 13 of the reverse rotation is set as the duty ratio of the PWM signal (S438), and then the routine is terminated.

When the positive rotation is set (S436: Yes), it is determined whether or not a Hysteresis flag is set (S440).

The Hysteresis flag is cleared when the pulling amount of the trigger switch 50 is increased. On the other hand, the Hysteresis flag is set while the trigger switch 50 returns to Stroke No. 14' after reaching Stroke No. 15, which is the upper limit position of the first stage (see FIGS. 8A and 8B).

When the Hysteresis flag is not set (S440: No), the duty level 13 of the positive rotation is set as the duty ratio of the PWM signal and the Hysteresis flag is cleared (S442), and then the routine is terminated.

When the Hysteresis flag is set (S440: Yes), it is determined whether or not the pulling amount of the trigger switch 50 is smaller than Stroke No. 14' (S444).

When the pulling amount of the trigger switch 50 is smaller than Stroke No. 14' (S444: Yes), it is determined that the pulling amount of the trigger switch 50 has become outside a range in which the duty ratio is set based on the Hysteresis characteristic thereby to have become Stroke No. 14, and the duty level 13 of the positive rotation is set as the duty ratio of the PWM signal (S442), and then the routine is terminated.

When the Hysteresis flag is set (S440: Yes) and the pulling amount of the trigger switch 50 is smaller than Stroke No. 15 and equal to or above Stroke No. 14' (S434: Yes, S444: No), it is determined that the pulling amount of the trigger switch 50 is held or reduced in the range in which the duty ratio is set based on the Hysteresis characteristic. In this case, a duty level 14, which is the same as that for Stroke No. 15 that is the upper limit position, is set as the duty ratio of the PWM signal based on the Hysteresis characteristic (S446), and then the routine is terminated.

Next, it is determined whether or not the pulling amount of the trigger switch 50 is smaller than Stroke No. 16 (S448). When the pulling amount of the trigger switch 50 is smaller than Stroke No. 16 (S448: Yes), it is determined whether or not the positive rotation is set by the rotation direction changing switch 90 (S450). When the pulling amount of the trigger switch 50 is smaller than Stroke No. 16 (S448: Yes), the trigger switch 50 has reached Stroke No. 15 that is the upper limit position.

Then, when the positive rotation is set by the rotation direction changing switch 90 (S450: Yes), the duty level 14 of the positive rotation is set as the duty ratio of the PWM signal and the Hysteresis flag is set (S452), and then the routine is terminated.

When the reverse rotation is set by the rotation direction changing switch 90 (S450: No), the duty level 14 of the reverse rotation is set as the duty ratio of the PWM signal (S454), and then the routine is terminated.

Thereafter, in S456 to S476, when the positive rotation is set by the rotation direction changing switch 90, an increase of the pulling amount of the trigger switch 50 increases the duty level of the positive rotation thereby to increase the rotating speed of the positive rotation of the motor 22, and then the routine is terminated. However, when the pulling amount of the trigger switch 50 is equal to or above Stroke No. 22 (S464: No), a duty level 21, which is the same as that for Stroke No. 22, is set.

On the other hand, in S456 to S476, when the reverse rotation is set by the rotation direction changing switch 90, it is determined that the pulling amount of the trigger switch 50 has become larger than the upper limit value of the first stage to set a constant duty level 14 regardless of the pulling amount of the trigger switch 50, and then the routine is terminated. Accordingly, when the reverse rotation is set, the rotating speed of the motor 22 is held at the maximum rotating speed of the first stage.

In the embodiment described above, the upper limit position when the trigger switch 50 is displaced is regulated to an upper limit position of any one of the plurality of stages by the user's manipulation of the pulling amount changing switch 70, thereby to allow the trigger switch 50 to be easily held at each upper limit position. As a result, the rotating speed of the motor can be easily held at the rotating speed corresponding to the upper limit position. Therefore, an extended time of a working operation can be easily conducted while holding the rotating speed of the motor constant.

Furthermore, the proportion of the set number of duty ratios to the manipulable amount of the trigger switch 50 is higher in the first stage than in the stages other than the first stage. Therefore, when the motor 22 is rotated at a slow speed in the first stage, the duty ratio can be minutely changed with respect to the manipulation amount of the trigger switch 50. Accordingly, the rotating speed of the motor can be minutely adjusted to control the rotating speed of the motor with high resolution. As a result, workability during a low speed is improved.

Also, the manipulable amount of the trigger switch in the first stage is set larger than the manipulable amount of the trigger switch 50 in the other stages. Accordingly, the range of the rotating speed of the motor that can be selected is widened in the first stage in which the proportion of the set number of duty ratios to the manipulation amount is higher than in the other stages. Therefore, the rotating speed of the motor can be controlled with high precision in a wide range of the rotating speed on the low speed side. As a result, workability during the low speed rotation is improved.

Also, in the first stage of the trigger switch 50, when the trigger switch 50 is increased to the upper limit position, the duty ratio is controlled so that the rotating speed of the motor increases. When the trigger switch 50 returns from the upper limit position to Stroke No. 14' that is a predetermined position, the duty ratio is controlled by the Hysteresis characteristic in which the rotating speed of the motor is the same as that for Stroke No. 15 and remains constant until the trigger switch 50 returns to Stroke No. 14'.

Accordingly, in the first stage, even if the fingers are loosened while the trigger switch 50 is held at the upper limit position with the fingers, the rotating speed of the motor does not change until Stroke No. 14'. As a result, in the first stage, when the extended time of a working operation is conducted while holding the trigger switch 50 at the upper limit position, the rotating speed of the motor is easily held constant.

Also, the reverse rotation of the mowing blade 36 can be selected by the rotation direction changing switch 90, and in the first stage of the reverse rotation, the rotating speed of the motor is increased as the pulling amount of the trigger switch 50 increases. Accordingly, the number of working patterns of the grass mower 10 is increased.

For example, when the grass clings around the mowing blade 36 by the positive rotation at a usual operation, the motor 22 can be reversely rotated to remove the grass while the user holds the grass mower 10.

In this embodiment, the grass mower 10 corresponds to an example of a power tool according to the present invention; the mowing blade 36 corresponds to an example of a tool according to the present invention; the trigger switch 50 corresponds to an example of a rotating speed adjusting switch according to the present invention; the pulling amount changing switch 70 corresponds to an example of a regulating member according to the present invention; and the microcomputer 102 corresponds to an example of a control unit according to the present invention.

Also, the pulling amount of the trigger switch 50 corresponds to an example of a manipulation amount of a rotating speed adjusting switch according to the present invention.

Also, processing from S400 to S476 shown in FIGS. 10 to 18 corresponds to an example of the function executed by the microcomputer 102 that is an example of a control unit according to the present invention.

[Other Embodiments]

In the above embodiment, the pulling amount of the trigger switch 50 is mechanically regulated to three stages by the pulling amount changing switch 70. However, the pulling amount of the trigger switch 50 is not limited to three stages, and may be mechanically regulated into a plurality of stages.

Also, in the stages other than the first stage, when the pulling amount of the trigger switch 50 is reduced from the upper limit position to a predetermined position, the duty ratio may be controlled by the Hysteresis characteristic in which the rotating speed of the motor remains constant from the upper limit position to the predetermined position.

Also, when the reverse rotation of the mowing blade 36 is set, the rotating speed of the motor 22 may be increased as the pulling amount of the trigger switch 50 increases, not only in the first stage but also in the other stages.

In this case, the rotating speed of the motor 22 may be increased as the pulling amount of the trigger switch 50 increases in the second stage while the rotating speed of the motor 22 may be held at the maximum rotating speed of the second stage regardless of the pulling amount of the trigger switch 50 in the third stage.

In other words, when the reverse rotation of the motor is selected in the power tool, at least in the first stage of the plurality of stages, motor control is executed such that the rotating speed of the motor is increased as the manipulation amount increases. In the stages other than the first stage, the rotating speed of the motor may be set to the maximum rotating speed in the highest stage of the stage numbers in which the previously mentioned motor control is executed, to hold the rotating speed of the motor constant.

Also, the manipulable amount in the first stage is not necessarily larger than in the other stages, but a magnitude in the manipulable amount in each stage may be set in any manner.

Although the above-mentioned embodiment described the grass mower 10 in which not only the positive rotation but also the reverse rotation can be set, the present invention may be applied to the grass mower in which only the positive rotation can be set and the reverse rotation cannot be set.

Also, although an example in which the present invention is applied to the grass mower was illustrated in the above-mentioned embodiment, the embodiment is only for the purpose of illustration, and the present invention can be applied to all types of power tools that operate using a motor as a driving source, e.g., a hedge trimmer and a driver.

In contrast to the above-mentioned embodiment, in the grass mower which does not mechanically regulate the upper limit position of the trigger switch 50 to a plurality of stages, when the pulling amount of the trigger switch 50 is reduced from the upper limit position to the predetermined position, the duty ratio may be controlled by the Hysteresis characteristic in which the rotating speed of the motor remains constant from the upper limit position to the predetermined position.

Alternatively, in the grass mower in which the upper limit position of the trigger switch 50 is mechanically regulated to the plurality of stages but the proportion of the set number of duty ratios to the manipulable amount of the trigger switch 50 in the first stage is not higher than in the stages other than the first stage, when the pulling amount of the trigger switch 50 in the first stage is reduced from the upper limit position to the predetermined position, the duty ratio may be controlled by the Hysteresis characteristic in which the rotating speed of the motor remains constant from the upper limit position to the predetermined position.

A driving method of the motor of the power tool may include: using a switch itself to reverse the direction of the current flowing through the motor thereby to change the rotation direction as in the present embodiment; using an H bridge circuit; or using an inverter circuit for driving a brushless motor.

In the above-mentioned embodiment, the function of the control unit according to the present invention is realized by the microcomputer 102 in which the function is identified by the control program. In contrast to this, at least a part of the function of the control unit may be realized by a hardware in which the function is identified by a circuit configuration itself.

Thus, the present invention shall not be limited to the above-mentioned embodiment, and applicable to various embodiments in a scope not departing from the gist of the present invention.

The invention claimed is:

1. A power tool comprising:

a motor configured to drive a tool;

a rotating speed adjusting switch configured to be displaced by manipulation by a user;

a regulating member configured to regulate an upper limit position when the rotating speed adjusting switch is displaced to an upper limit position of any one of a plurality of stages by the manipulation by the user; and a control unit configured to control an amount of a current flowing to the motor by a duty ratio based on a manipulation amount of the rotating speed adjusting switch, the control unit being configured to increase the rotating speed of the motor in accordance with an increase in the manipulation amount, a predetermined set number of duty ratios being set for each of the plurality of stages, and a proportion of the set number of duty ratios to a manipulable amount of the rotating speed adjusting switch being higher in a first stage, where the upper limit position is the smallest, than in stages other than the first stage, wherein the control unit is further configured to control the duty ratio so that the rotating speed increases when the manipulation amount of the rotating speed adjusting switch increases to the upper limit position at least in the first stage of the plurality of stages, and to control the duty ratio, when the manipulation amount is reduced from the upper limit position to a predetermined position, by a Hysteresis characteristic in which the rotating speed remains constant until the manipulation amount reaches the predetermined position, the predetermined position excluding an initial position of the rotating speed adjusting switch.

2. The power tool according to claim 1, wherein the regulating member is configured to regulate the upper limit position so that the manipulable amount in the first stage is larger than the manipulable amount in the stages other than the first stage.

3. The power tool according to claim 1, comprising a rotation direction changing switch configured to change rotation of the motor to one of a positive rotation and a reverse rotation by manipulation by the user, wherein the control unit is further configured to increase the rotating speed as the manipulation amount increases at least in the first stage, and to hold the rotating speed constant regardless of the manipulation amount in the stages other than the first stage, when the reverse rotation of the motor is selected by the rotation direction changing switch.

4. The power tool according to claim 2, comprising a rotation direction changing switch configured to change rotation of the motor to one of a positive rotation and a reverse rotation by manipulation by the user, wherein the control unit is further configured to increase the rotating speed as the manipulation amount increases at least in the first stage, and to hold the rotating speed constant regardless of the manipulation amount in the stages other than the first stage, when the reverse rotation of the motor is selected by the rotation direction changing switch.

* * * * *